US008968068B2

(12) United States Patent
Ghaly

(10) Patent No.: US 8,968,068 B2
(45) Date of Patent: Mar. 3, 2015

(54) METHOD AND APPARATUS FOR A GAMING DEVICE

(76) Inventor: Nabil N. Ghaly, South Huntington, NY (US)

( * ) Notice: Subject to any disclaimer, the term of this patent is extended or adjusted under 35 U.S.C. 154(b) by 780 days.

(21) Appl. No.: 12/011,278

(22) Filed: Jan. 26, 2008

(65) Prior Publication Data

US 2008/0214267 A1 Sep. 4, 2008

Related U.S. Application Data

(60) Provisional application No. 60/898,133, filed on Jan. 30, 2007.

(51) Int. Cl.
*G07F 17/00* (2006.01)
*G07F 17/32* (2006.01)

(52) U.S. Cl.
CPC ..... *G07F 17/32* (2013.01); *G07F 17/3227* (2013.01); *G07F 17/3267* (2013.01); *G07F 17/3295* (2013.01)
USPC ..... 463/16

(58) Field of Classification Search
CPC ..... G07F 17/3213
USPC ..... 463/16
See application file for complete search history.

(56) References Cited

U.S. PATENT DOCUMENTS

| | | | | |
|---|---|---|---|---|
| 5,935,002 | A * | 8/1999 | Falciglia | 463/19 |
| 5,988,638 | A * | 11/1999 | Rodesch et al. | 273/143 R |
| 6,364,766 | B1 * | 4/2002 | Anderson et al. | 463/16 |
| 7,387,570 | B2 * | 6/2008 | Randall | 463/20 |
| 7,749,073 | B2 * | 7/2010 | Thomas et al. | 463/20 |
| 2004/0023714 | A1 * | 2/2004 | Asdale | 463/22 |

OTHER PUBLICATIONS

Hasbro, Boggle CD-ROM. Created 1997.*

* cited by examiner

*Primary Examiner* — Reginald Renwick

(57) ABSTRACT

A bonus game for a slot machine, method and apparatus, is disclosed and is based on a playfield configured as a matrix of playing positions, wherein each playing is used to display a character of the alphabet, and wherein a plurality of words are hidden in the playfield. During the bonus game, the rows and/or columns of the playfield are rotated, and then are randomly stopped to uncover hidden words. Each hidden word has a payout amount associated with it, which is paid to the player upon uncovering the word. A plurality of sound and visual effects is also provided to heighten the enjoyment of the bonus game.

20 Claims, 7 Drawing Sheets

METHOD AND APPARATUS FOR A GAMING DEVICE

PARENT CAST TEXT

This utility application benefits from provisional application of U.S. Ser. No. 60/898,133, filed on Jan. 30, 2007.

BACKGROUND OF THE INVENTION

This invention relates generally to coin operated gaming machines, also known as slot machines, and in particular to a coin operated gaming machine wherein a coin or a value input device, a start lever, a primary gaming unit, a secondary gaming unit to provide a bonus game, and a currency validating module are provided. The primary gaming unit could be a conventional machine having a plurality of rotating reels, a card gaming machine, or of the type disclosed in U.S. patent application Ser. No. 10/917,129 as filed in the Patent Office on Aug. 14, 2004, inventor Nabil N. Ghaly, 36 pages of text, 28 drawing sheet; i.e., based on random assignment and manipulation of binary numbers, and the generation of corresponding displays at a plurality of playing positions.

There are many conventional slot machines that enable a player to activate a lever, which in turn causes a plurality of reels to spin and ultimately stop to display a random combination of some form of indicia at one, or a plurality of pay lines. If this display contains one of a pre -selected plurality of winning combinations, the machine releases money into a payout chute or onto a credit meter for the player. A number of these machines offer the player a second opportunity to win in the form of a bonus game. Such bonus game is operable when one or more reels of the primary gaming unit stop on certain predetermined indicia at an activated pay line. The bonus game can then be activated by the player, and may result in additional winning payouts.

Since it is desirable to offer players games that they have not played before, it is one object of the current invention to offer players a new game that provides excitement and additional opportunities to receive winning payouts.

It is also an object of this invention to provide an interactive bonus game based, wherein a plurality of words are hidden in a playfield, and are uncovered during the bonus game by shifting alphabet characters along columns, rows, and/or diagonal axes.

It is still an object of this invention to provide a bonus game for a slot machine that includes a playfield having a plurality of playing positions, wherein each playing position is used to display a character of the alphabet, wherein at least one word is hidden on the playfield, wherein playing positions are shifted with respect to each other during the bonus game, wherein said shifting of playing positions is stopped at random to uncover hidden words, and wherein a bonus payout amount is associated with each uncovered word.

It is another object of this invention to provide a slot machine, having a field of play that is presented to a player on a CRT or an LCD screen, and which consists of a plurality of playing positions each of which displays a character of an alphabet that may be combined with adjacent letters or characters to form words.

It is also an object of this invention to provide a slot machine with a playfield that includes a plurality of words hidden from the player by a scrambling process that shifts rows and/or columns relative to each other.

It is a further object of this invention to provide a slot machine, having a field of play wherein entire rows of letters are continuously shifting left or right, for a random duration of time, or until stopped by a random process activated by the player.

It is still another object of this invention to provide a slot machine, having a field of play wherein entire columns of letters are continuously shifting up or down, for a random duration of time, or until stopped by a random process activated by the player.

It is also an object of this invention to provide a slot machine with a field of play wherein predetermined words are hidden along horizontal, vertical or diagonal axes.

It is a further object of this invention to provide a slot machine with a field of play wherein a winning payout is provided to the player for each winning word uncovered by the random process of shifting rows and/or columns.

It is another object of the current invention to provide a slot machine with a field of play wherein a predetermined plurality of words are hidden, and wherein a random process is employed to uncover said hidden words, and wherein the player is given a choice to accept or reject the payout associated with uncovered words.

It is also an object of this invention to provide a slot machine with a field of play wherein a random process is used to control the shifting of rows and/or columns, and wherein rows and columns corresponding to winning words accepted by a player are frozen, and prevented from any further shifting.

It is still an object of this invention to provide a slot machine wherein a random process is used to uncover words hidden in a field of play by shifting entire columns and/or rows relative to each other, and wherein the game ends when all rows and columns are frozen, or when the player exhausts a predetermined number of opportunities to reject uncovered winning words.

It is a further object of this invention to provide a bonus game wherein the ultimate objective of the game is for the player to uncover predefined set of hidden words that qualify the player to win the highest prize (jackpot).

SUMMARY OF THE INVENTION

The foregoing and other objects of the invention are accomplished by a coin operated gaming machine having a first gaming unit of the rotating reels type, providing a card game, or of the type disclosed in U.S. patent application Ser. No. 10/917,129, as filed in the Patent Office on Aug. 14, 2004, inventor Nabil N. Ghaly, 36 pages of text, 28 drawing sheet; i.e., based on random assignment and manipulation of binary numbers, and the generation of corresponding displays at a plurality of playing positions. According to a preferred embodiment, the bonus game is operable when primary reels of a slot machine stop on certain predetermined indicia at an activated pay line. It would be preferable for the various symbols on the reels to depict, or be associated with alphabet or language memorabilia. The bonus game is based on hiding a plurality of words in a field of play configured as an array of playing positions, wherein a plurality of alphabet characters are assigned to said playing positions such that a playing position indicates one character of the alphabet. The rows and columns of said field of play are rotated, and then stopped at random to uncover hidden words. A bonus payout is associated with each hidden word, and is awarded to the player upon uncovering the word during the bonus game.

The preferred embodiment includes a separate screen that provides a field of play for the bonus game. The screen could be implemented using Liquid Crystal Display (LCD), Digital Light Processor (DLP), or plasma technology. The field of play for the preferred embodiment includes an array of nine (9) rows and nine (9) columns, which form 81 playing positions. Each playing position has an assigned character of the alphabet. Further, each row could be shifted horizontally (i.e., to the left or to the right), and each column could be shifted vertically (i.e., up or down). Words are formed on a row, on a column, or on a diagonal. In addition, words could be spelled backward (i.e., right to left, bottom to top, bottom right to top left, or bottom right to top left).

It should be noted that the number of playing positions in the playfield, and the configuration of rows and columns are design choices. As would be appreciated by a person skilled in the art, the playfield could in general be configured as n rows, and m columns to provide an array of n×m playing positions. Alternatively, the playfield could be configured without rows and columns. For example, a circular playfield could be provided, wherein playing positions are rotated along a circular ring. As would be appreciated by one skilled in the art, what is important is for the playing positions to be shifted relative to each other so that words on the playfield could be scrambled and hidden from the player during the bonus game.

The 81 letters that form the field of play for the preferred embodiment are captive, i.e., they remain the same during the bonus game. When a row is shifted to the left, the character at the first position (left most character on the row) wraps around the playfield to become the last character on that row. Alternatively, if the row is shifted to the right, the character at the last position (right most character on the row) wraps around the playfield to become the first character on that row. Similarly, when a column is shifted upward, the top character on the column wraps around the playfield to become the bottom character on that column. Alternatively, if the column is shifted downward, the bottom character on the column wraps around the playfield to become to the top character on that column.

The bonus game has two shift or rotation phases. During the first phase, the odd rows are shifted or rotated to the left, and the even rows are rotated to the right. During the second phase, the odd columns are rotated upwards, and the even columns are rotated downwards. A random number generator is used to randomly stop the rows and columns after each phase. The first and second rotation phases form a rotation cycle.

The playfield for the preferred embodiment includes a plurality of hidden words that are formed on various rows, columns, and/or diagonals. Specific words are formed when rows and/or columns that map these words are aligned in specific positions. One of the words hidden in the playfield is the term "jackpot." Each word has a specific bonus payout that is dependent on the wager deposited by the player during the last spin or game, and/or the number of lines activated by the player in the underlying slot machine. Further, the term "jackpot" has the highest bonus payout. The object of the bonus game is to uncover as many words as possible following the completion of the two shift or rotation cycles. The player is not required to use any skills to uncover hidden words. Rather, at the completion of the second rotation phase, a segment of a software program automatically uncovers all hidden words that are formed based on the random alignment of rows and columns. This software program is embedded in the memory of the microprocessor that controls the operation of the bonus game. Further, a software segment calculates the total bonus payout that corresponds to all words uncovered after the completion of the two rotation phases.

The bonus game provides the player with a plurality of opportunities, i.e. a plurality of rotation cycles, to accept said bonus payout calculated after the completion of the second rotation phase. The player can reject a bonus payout offer, and in such case the two rotation phases are repeated, and a new offer is made to the player based on the newly uncovered words. Once these opportunities are exhausted, the player has no choice but to accept the last bonus payout offer corresponding to words uncovered at the last rotation cycle.

It should be noted that the above description of the bonus game is set forth herein for the purpose of describing the preferred embodiment, and is not intended to limit the invention herein. As would be appreciated by a person skilled in the art, a number of modifications, additions, and/or enhancements could be made to the bonus game. For example, the bonus payout could be based on the number of words uncovered rather than on payouts that are associated with specific predetermined words. In such a case, the highest bonus payout is associated with the largest number of predetermined words uncovered, including the term "jackpot." This jackpot condition occurs at predetermined positions of all rows and columns. Further, there is no need to have two shift or rotation sequences. A game designer may elect to implement a single rotation phase (up-down, or left-right), or select the direction of rotation using a random process. Also, the rotation direction does not have to be confined to up, down, left, or right. A game designer may elect to implement a rotation along one of the diagonal directions.

Further, a playfield does not have to be configured as rows and columns. Any playfield that includes a plurality of playing positions, wherein said playing positions are shifted with respect to each other, and then are randomly stopped to uncover hidden words could form the basis for the bonus game.

In addition, the 81 letters used for the preferred embodiment do not have to remain captive during the bonus game. For example, each time a player rejects an offer, a new board could be used for the following rotation cycle. Furthermore, a bonus game could employ a plurality of boards. In such case, the selection of a board could be based on the amount of wager deposited by the player, and/or the number of pay lines activated by the player in the underlying gaming machine.

Also, it is not necessary for each playing position to include a letter of the alphabet. A game designer may elect to leave one, or a plurality of playing positions blank, or to assign a symbol, or a plurality of symbols, to one or a plurality of playing positions. Further, a game designer may elect to assign a plurality of alphabet characters to a single playing position, rather than a single character per playing position as described in the preferred embodiment.

The present invention also comprises methods for playing a bonus game of chance. One preferred method is related to a field of play that includes a plurality of playing positions configured as n rows, and m columns, wherein each playing is used to indicate a letter of the alphabet, and wherein a plurality of pre-determined words are hidden in the playfield. The game of chance then includes the steps of rotating, and randomly stopping said rows, and columns, to uncover predetermined words that are formed when the rows and columns are randomly stopped and aligned at certain positions, and determining a bonus payout associated with the uncovered words.

BRIEF DESCRIPTION OF THE DRAWINGS

These and other more detailed and specific objectives will be disclosed in the course of the following description taken in conjunction with the accompanying drawings wherein.

Figure 1:
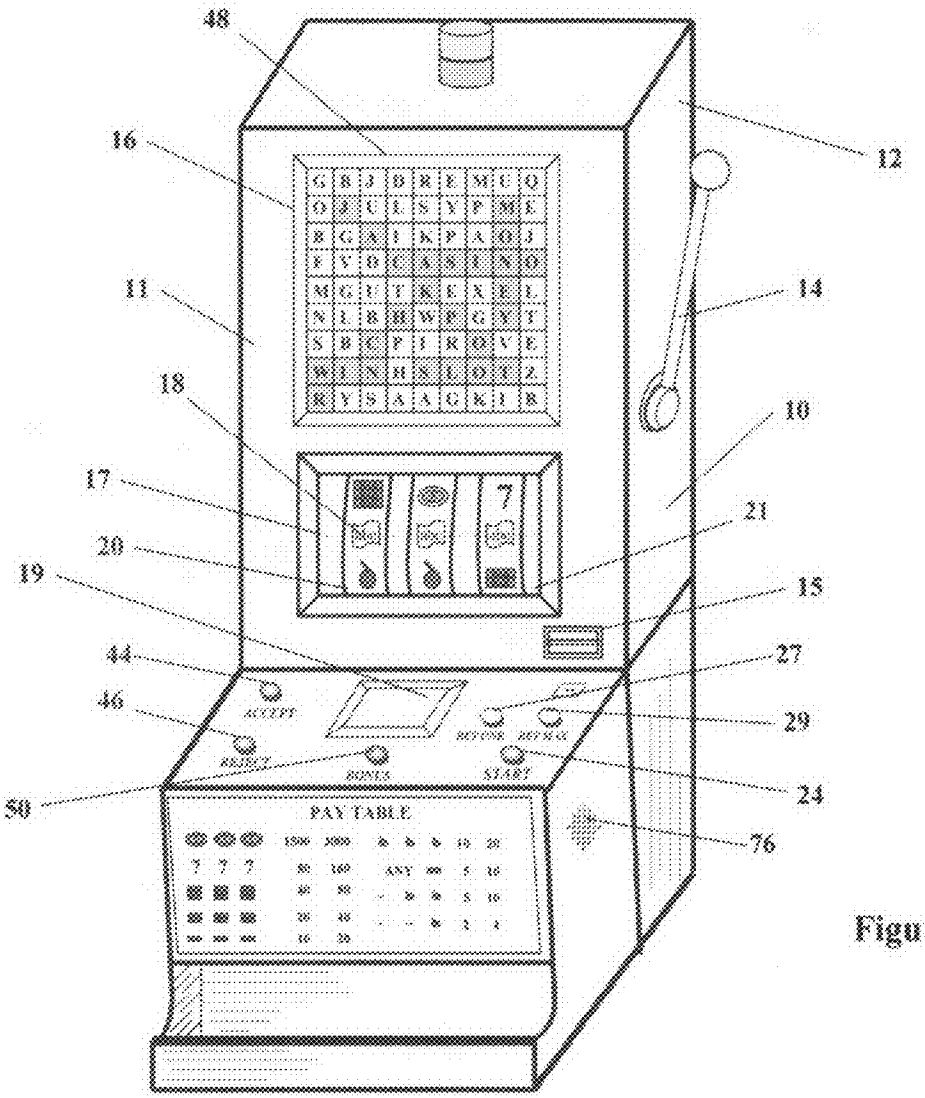
FIG. 1 is a perspective view of the preferred embodiment of a coin operated gaming machine according to the invention.

While the invention is susceptible to various modifications and alternative forms, specific embodiments have been shown by way of example in the drawings and will be described in detail herein. It should be understood, however, that the invention is not intended to be limited to the particular forms disclosed. As would be appreciated by persons of ordinary skills in the art, alternative fields of play with geometric rotation patterns could be derived. In such an implementation, the alphabet characters are shifted clockwise, or counter clockwise along said rotation patterns, and are stopped using a random number generator so that pre-determined words could be uncovered on the playfield. Accordingly, the invention is to cover all modifications, equivalents, and alternatives falling within the spirit and scope of the invention as defined by the appended claims.

DESCRIPTION OF THE PREFERRED EMBODIMENT

The preferred embodiment of the present invention is designed to provide added excitement to a primary or underlying gaming device in order to increase the enjoyment to players and to serve as an added attraction to potential players. Referring now to the drawings where the illustrations are for the purpose of describing the preferred embodiment of the invention and are not intended to limit the invention hereto, FIG. 1 is a front plan view of a gaming machine 10 is comprised of a housing 12 having three rotating reels 20, each of which has a plurality of reel symbols on the periphery thereof. The preferred embodiment employs a single pay line 17. Said symbols could include conventional slot machine symbols, i.e., cherry, bar, double bar, triple bar, and/or lucky seven, or could include images related to the word bonus game. The gaming machine 10, also, includes a CRT or an LCD screen 16 to display images associated with the bonus game. In addition, the gaming machine 10 has conventional controls including an activation mechanical lever 14, currency acceptor slot 15, a currency validator (not shown), a start button 24, "BET ONE" 27, and "BET MAX" 29 buttons. Further, the preferred embodiment includes a Liquid Crystal Display (LCD) screen 19, which provides the player with game information, including the amount of wager deposited by the player, number of credits won, and balance of remaining credit. Furthermore, the preferred embodiment employs an "ACCEPT" switch 44, and a "REJECT" switch 46 to enable a player to accept, or reject payout offers during the bonus game. Said payout offers are displayed on the bonus screen 16.

In a manner that will be recognized by those skilled in the art, each reel 20 is designed to rotate, and then stop in order to visually display at least one, and preferably a number of indicia. If the combination of indicia displayed by the three reels 20 at the pay line 17 is one of a predetermined plurality of winning indicia sets, then the player can typically be provided with a winning payout either through coin chute, which deposits winnings into a coin trough, or by increasing the player's credits indicated on the game information screen 19. According to the present invention, when the reels 20 display a particular indicia combination 18 at the pay line 17, then the player is provided with an opportunity for a bonus game. For the preferred embodiment, said indicia is in the form of a graphic symbol that includes the letters "acb."

Upon the occurrence of said indicia combination 18, a bonus actuator button 50 is placed in an operative state, and the player is instructed to depress said bonus actuator button 50 in order to start the bonus game. Then upon the activation of the bonus actuator 50, a playfield of 81 playing positions (configured as 9 rows and 9 columns), wherein each playing position is used to display a letter of the alphabet, is presented to the player on the bonus screen 16. This initial presentation of the playfield to the player is based on predetermined optimum placements of the alphabet characters on the playfield such that a maximum number of predetermined words are aligned at various rows, columns, and/or diagonals. Said predetermined words are highlighted on the playfield to identify their locations to the player. As rows and columns are shifted, or rotated, on the playfield, the initial set of words presented to the player are scrambled, and hidden from the player. However, at each combination of row and column rotation positions, different sets of predetermined words are formed. A set of predetermined words could include words from the initial presentation of the playfield to the player, and could also include different words.

A pay table accessible to the player provides the payout amount associated with each predetermined word, for all words that are formed at the various rotation positions of rows and columns. For the preferred embodiment, there are nine (9) rotation positions for each column, and nine (9) rotation positions for each row.

After the initial presentation of the playfield, the player is requested to activate the start button 24 in order to initiate a first rotation phase. Then, upon the activation of the start button 24, the rows on the playfield begins to rotate such that odd rows are shifted, or rotated, to the left, and even rows are rotated to the right. Each row continues to rotate for a few seconds until it is randomly stopped, by the control program logic that controls the bonus game, at one of the nine (9) rotation positions. A random number generator is used to generate nine (9) random numbers, each of which corresponds to a stopping position for each of the nine (9) rows.

Upon the random stopping of the rows, the player is requested to activate the start button 24 for a second time in order to initiate a second rotation phase. Upon said second activation of the start button 24, the columns on the playfield begins to rotate such that odd columns are shifted, or rotated, upward, and even columns are rotated downward. Similar to the first rotation phase, the columns continue to rotate for a few seconds until they are randomly stopped by said control program logic. The random number generator is used to generate nine (9) random numbers, each of which corresponds to a stopping position for each of the nine (9) columns.

Following the completion of the two rotation phases, a segment of the control program logic uncovers the predetermined words forming at the playfield, and calculates a bonus payout amount based on the payout amount associated with each uncovered word. A first bonus payout offer is then made to the player on the LCD screen 16. The player is requested to either accept, or reject said first offer by activating the "ACCEPT" button 44, or the "REJECT" button 46. If the player accepts the first bonus payout offer, then he or she is credited the amount of said first offer, the bonus game is terminated, and the underlying or primary slot machine game is resumed.

Alternatively, if the player activates the "REJECT" button 46, then a segment of the control program logic initiates a new rotation cycle by repeating the steps for the two rotation phases, and a second bonus payout offer is made to the player. Similar to the first payout offer, the player is given the choice to accept or reject said second offer. In the event the player accepts the second offer, he or she is credited the amount of the second offer, the bonus game is terminated, and the underlying slot machine game is resumed. Alternatively, if the player rejects the second offer, a third and final offer is made based on a third rotation cycle, and a repeat of the two rotation phases. The player must accept the third and final bonus payout offer.

It should be noted that the above described operation and methodology for the bonus game are being disclosed herein for the purpose of describing the preferred embodiment, and are not intended to limit the invention hereto. As would be appreciated by a person of ordinary skills in the art, certain design choices, modifications, deletions, or additions are possible. For example, the initiation of a rotation phase could be controlled automatically by the control program logic without an input from the player. Conversely, the player could control the random stopping of the column, and row rotations. Also, the number of bonus payout offers is a design choice. A game designer may elect to implement a single offer. Alternatively, the number of offers could exceed the three offers described in the preferred embodiment, or could be determined at random using a random number generator. Further, the bonus payout offers could be cumulative, i.e. the player is credited the amounts of the bonus payout for the first, second, third, etc. rotation cycles. In such a case, the player is not required to accept or reject any offer. Rather, the player would be required to activate an entry control mechanism that would in turn initiates the execution of a control program segment, which employs a random number generator, to determine the number of rotation cycles awarded to the player.

In addition, the rotation of rows and/or columns could be implemented in a single direction rather than in two directions as described in the preferred embodiment. Further, a game designer may elect to implement a single rotation phase for each rotation cycle along rows, columns or diagonals. Furthermore, the number of rotation positions for rows and/or columns could be limited to fewer than the nine (9) positions described in the preferred embodiment.

As would be appreciated by a person of ordinary skills in the art, the random process to stop the rotation of rows and columns employs a random number generator, and is implemented by a program segment of the control program logic. For each rotation phase, the random number generator is used to generate a plurality of random numbers, each of which is used to stop a row, or a column at a specific stopping position. For example, if the random number generator generates the numeric digit "5" for the second column, then said second column will stop at the fifth stopping position. For the preferred embodiment, each column, and each row has nine (9) stopping positions.

There are a number of design choices to implement the random stopping of rows and/or columns. A first design choice could be based on an equal chance for each row and/or column to stop at any of the associated 9 stopping positions. Alternatively, the probability that certain row, or column stops at a specific stopping position could be based on an overall probability associated with an amount of bonus payout. Since the amount of bonus payout is based on the specific words uncovered after the two rotation cycles, it follows that said amount corresponds to the specific positions of rows and columns at which these uncovered words are formed. In such a case, a single number is generated by the random number generator, and is associated with a specific bonus payout amount. In turn, said bonus payout amount is associated with pre-determined hidden words, which are uncovered at specific stopping positions for the rows and columns. A lookup table could be used to associate the generated random number with said specific stopping positions. Upon the generation of said random number, the control program will determine the stopping positions for the rows and columns, using the lookup table, and will use this information to stop the rows, and columns during the first and second rotation phases.

Figure 2:
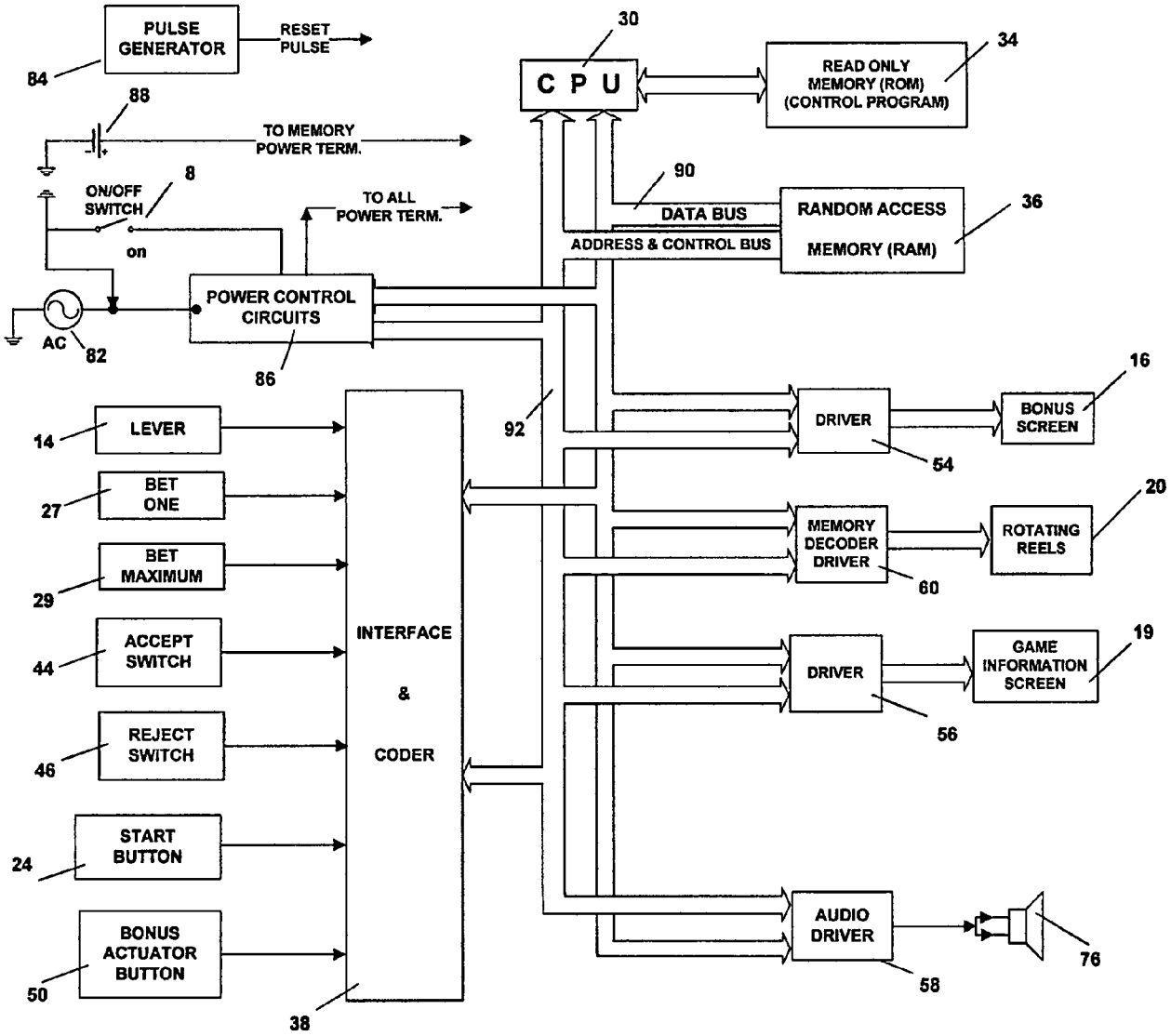
FIG. 2 indicates a block diagram of the microprocessor circuitry used to control the bonus gaming device according to the invention.

A block diagram of the control circuitry to operate this gaming device 10 is illustrated in FIG. 2. This block diagram includes a micro-controller with a central processing unit (CPU) 30 and system memory. The system memory preferably comprises a separate read-only memory (ROM) 34 and battery-backed random-access memory (RAM) 36. It will be appreciated, however, that the system memory may be implemented on any of several alternative types of memory structures, or may be implemented on a single memory structure. For example, the read-only memory 34 may be replaced or supplemented with a mass storage unit such as a removable flash memory or a hard drive. The system memory is used to store game-related data associated with the chance games played on the gaming device. The game-related data may, for example, include game code, math tables, lookup tables, a random number generator, and audio resources.

An on/off toggle switch 8 is provided to control the operational state of the slot machine, and the connection of the external AC power supply 82 to the electric circuitry 86, which in turn energizes all terminals of the gaming device 10. The gaming device also includes a rechargeable battery 88, which feeds the memory power terminals in order to ensure that critical data is not lost in the event of a loss of the external electrical supply 82. Also, an interface and coding device 38 is used as an input interface between the various control elements and the CPU 30. These control elements include the main lever switch 14, the start button 24, "BET ONE" switch 27, "BET MAX" switch 29, "ACCEPT" button 44, "REJECT" button 46, "BONUS ACTIVATION" button 50, and other conventional control elements of a slot machine. Similarly LCD control drivers 54 & 56 are used to interface the CPU 30 with the bonus LCD screen 16, and the LCD screen 19 that provides game information to the player. Also, a memory decoder driver 60 is used to interface the CPU 30 with the mechanism that controls the rotation of the reels 20. In addition, an audio driver 58 is used to interface the audio circuits that activate the loudspeaker 76 with the CPU 30. A common address and control bus 92, and a separate common data bus 90 are used to interconnect the central processing unit 30 with the interface and coding device 38, the LCD drivers 54 & 56, the memory decoder driver 60, the audio driver 58, the read only memory (ROM) 34, and the random access memory (RAM) 36.

It should be noted that the above description of the block diagram illustrated in FIG. 2, and using interface and coding devices, memory decoding devices, and/or drivers is being provided for the purpose of describing the preferred embodiment, and is not intended to limit the invention herein. As would be appreciated by a person skilled in the art, a game designer may elect to use a microprocessor that includes input and output ports to interface input switches, indicators, and output devices with the CPU. Such microprocessors are well known in the art.

Figure 3:
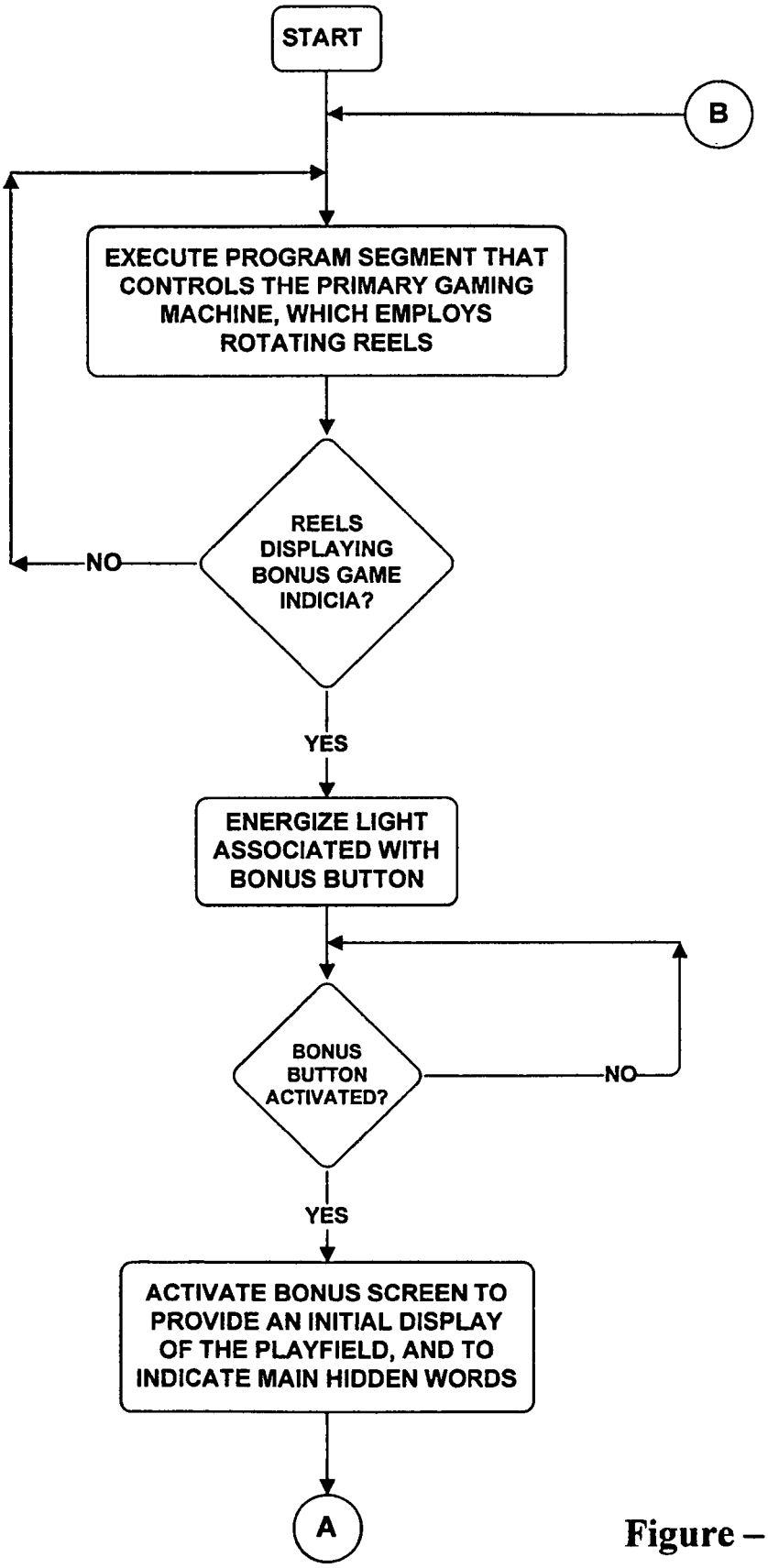
FIGS. 3-7 indicate a logical flow diagram illustrating the main program functions performed by the microprocessor controlling the bonus gaming machine according to the invention.
Figure 4:
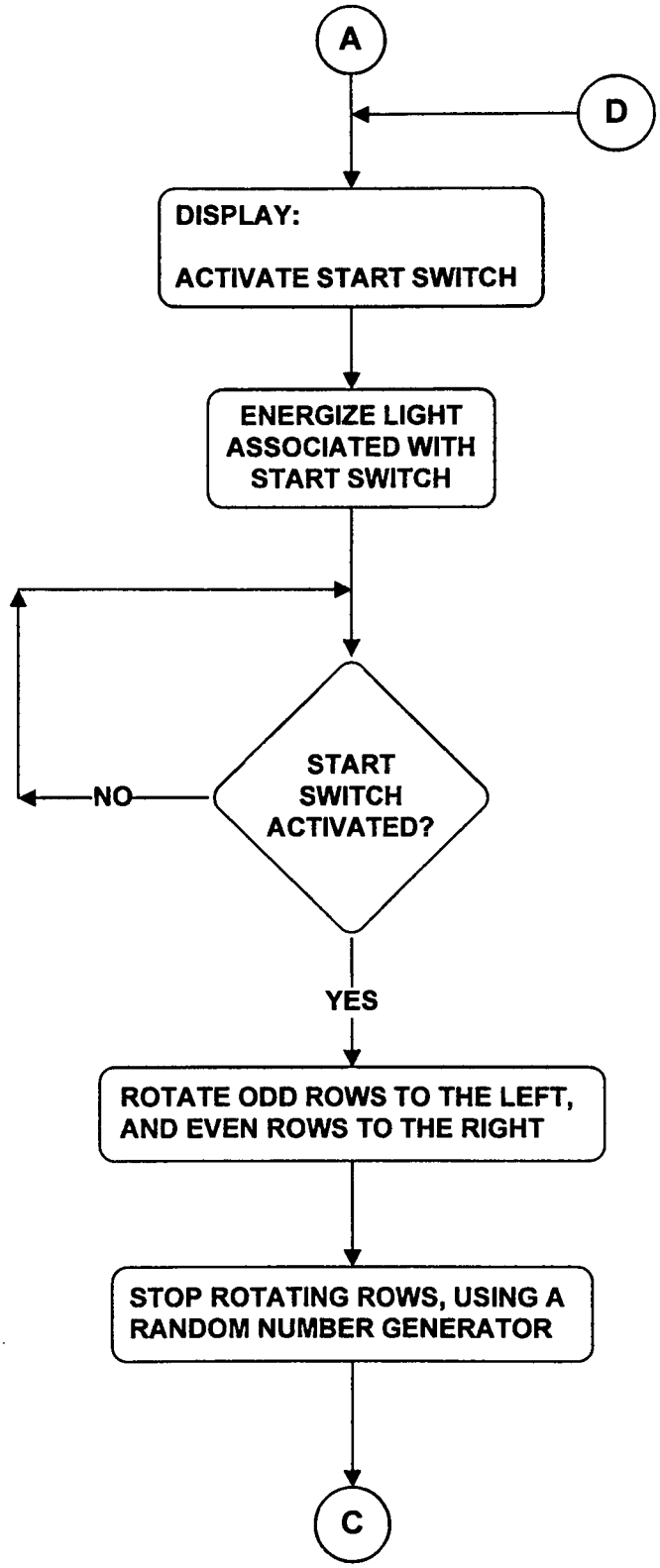
Figure 5:
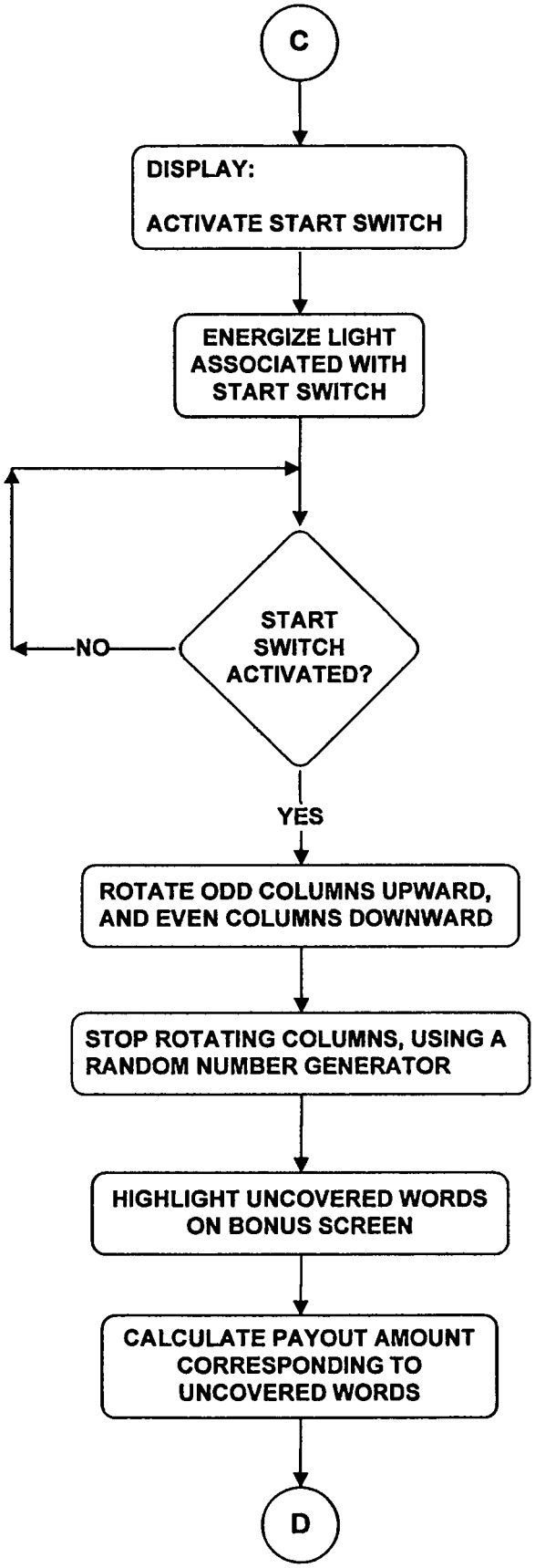
Figure 6:
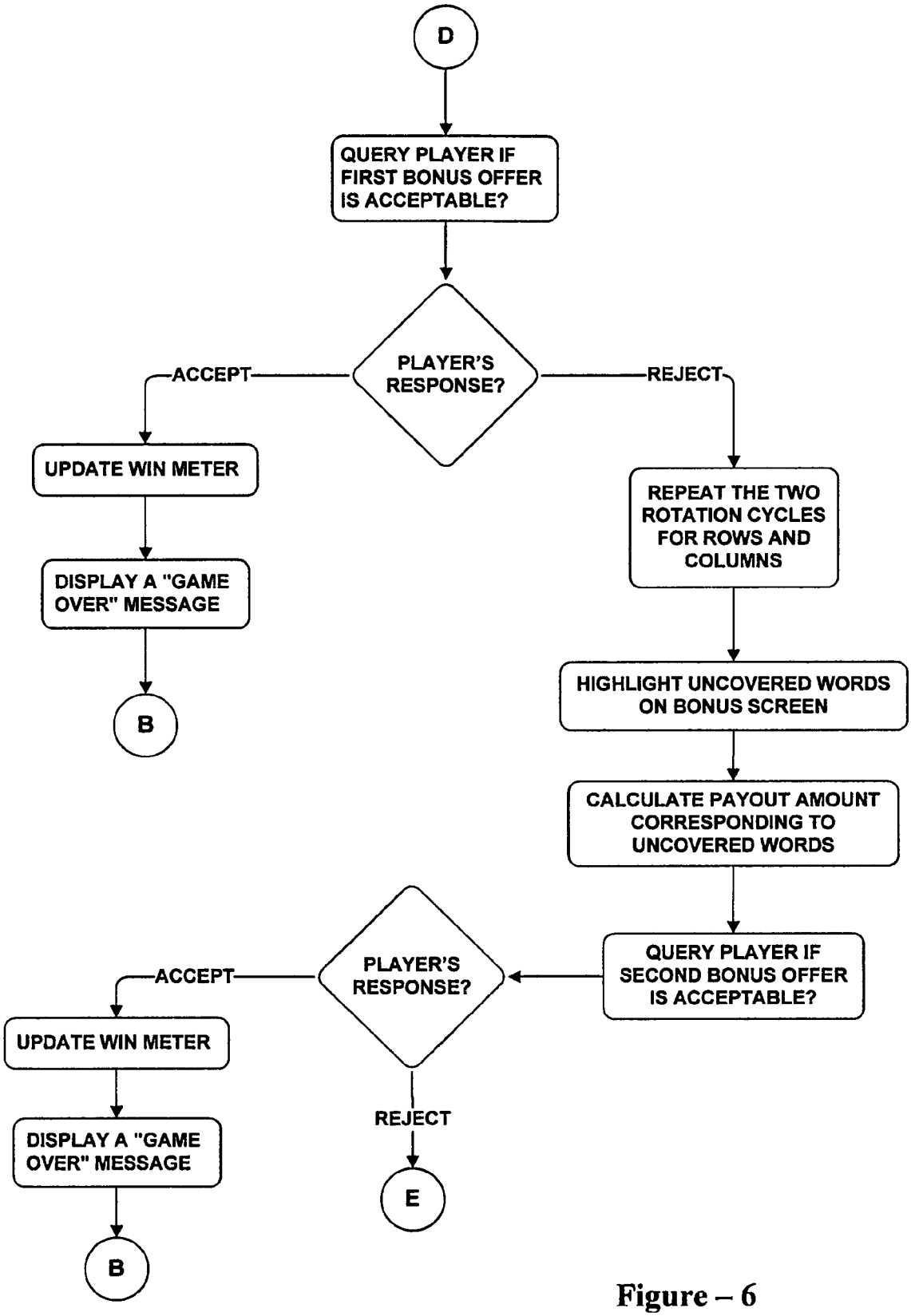
Figure 7:
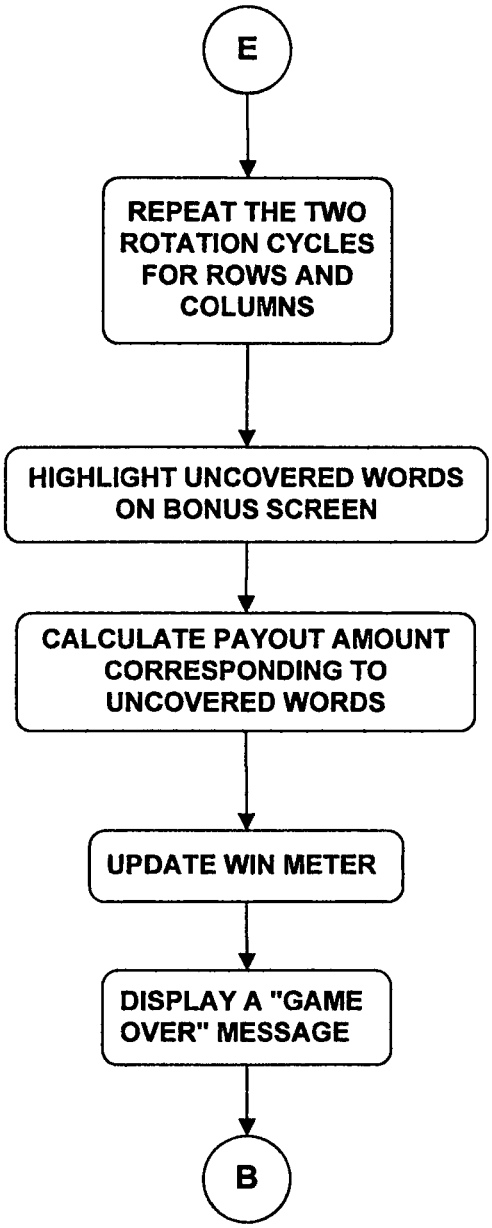

The preferred embodiment consists of two main parts. A primary gaming unit that employs rotating reels, and a bonus gaming unit that includes a playfield wherein a plurality of words are hidden, and are uncovered during the bonus game by randomly stopping rotating rows, and/or columns. Preferably, both units are controlled by different program segments of the same control program, which is embedded in the memory of the microprocessor that controls the gaming devoice, and resides in its ROM 34. The flow diagram of FIG. 3 shows the control program segment of the primary gaming unit as a single block. In order to activate the primary gaming unit, a player makes a wager by either pressing the BET ONE button 27, or the BET MAX button 29. After the player has selected the amount of his wager, he depresses the START button 24, or operates the main lever 14, which causes the reels 20 shown in display window 21 to spin. These reels include a plurality of indicia located on the perimeter of each reel. A random number generator is used to control the stopping of each reel such that it will visually display at least one, and preferably a number of indicia, through the display window 21. Upon the stopping of the reels 20, the CPU 30 determines if one or more winning combinations of symbols have occurred at the pay line 17. Also, the CPU 30 selectively accesses the audio resources to be played through one or more audio speakers 76 mounted to a housing of the slot machine. If the outcome after the movement of the reels corresponds to a winning combination outcome identified on a pay table, the CPU 30 instructs a payoff mechanism 55 to award the player a payoff for that winning outcome combination in the form of coins or credits. Further, when reels 20 display a particular indicia combination 18, or one of a predetermined plurality of indicia combinations, then the bonus game unit is activated, and a bonus button 50 is placed in an operable state that is indicated to the player by energizing an associated light.

With respect to the operation of the bonus game, the logic steps utilized are illustrated in flow diagram form in FIGS. 3-7, which interconnect with each other at the places shown in the various figures. Even though specific reference will not be made to this diagram in the following description of the operation of the bonus game, periodic reference to this diagram may prove to be helpful to the reader hereof.

Upon the activation of the "On-Off" switch 8, and the initialization of the program variables, the gaming device is ready to operate. The operation of the underlying reel slot machine is indicated in FIG. 3 as a single block. Upon the stopping of the reels, a segment of the control program makes a determination if the bonus game indicia have occurred at the pay line for the underlying gaming machine. If said bonus game indicia occur, then the bonus game is activated. Conversely, the underlying reel slot machine continues is normal operation.

To initiate the bonus game, the player is instructed to activate the bonus activation button 50. Then upon such activation, the control program provides an initial display of the playfield that indicates the main hidden words, and their positions on the playfield. The player is then instructed to activate the start button 24, in order to initiate the first rotation phase. Then upon the activation of the start button 24, the control program initiates the rotation of rows such that odd rows are rotated to the left, and even rows are rotated to the right. After a few seconds of rotation time, a control program segment that employs a random number generator stops the rotation of rows. The rotation time could be fixed, or could be a variable time period that is determined by the random number generator.

After the random stopping of the rotating rows, the player is instructed to activate the start button 24, for a second time, in order to initiate the second rotation phase. Then upon said second activation of the start button 24, the control program initiates the rotation of columns such that odd columns are rotated upward, and even columns are rotated downward. After a few seconds of rotation time, a control program segment that employs a random number generator stops the rotation of columns. Similar to the first rotation phase, the rotation time could be fixed, or could be a variable time period that is determined by the random number generator.

Upon the random stopping of the rotating columns, the control program determines if any hidden words are uncovered, calculates the bonus payout that is associated with the uncovered words, and generates a display on the bonus screen 16 that makes a first bonus offer to the player in the amount corresponding to the uncovered word. If the player accepts said first bonus offer, then the control program credits the amount of the first bonus to the player, and reactivates the underlying reel slot machine.

Conversely, if the player rejects the first bonus offer, then the control program repeats the program segments that control the first & second rotation phases, and generates a display on the bonus screen 16 that makes a second bonus offer to the player. If the player accepts this second bonus offer, then the control program credits the amount of the second bonus to the player, and reactivates the underlying reel slot machine. Conversely, if the player rejects the second bonus offer, then the control program repeats the program segments that control the first & second rotation phases, and generates a display on the bonus screen 16 that makes a third and final bonus offer to the player. The control program then credits the amount of said third and final bonus offer to the player, and reactivates the underlying reel slot machine.

As will be understood by those skilled in the art, many different programs may be utilized to implement the flow charts disclosed in FIG. 3 through FIG. 7. Obviously these programs will vary from one another in some degree. However, it is well within the skill of the computer programmer to provide particular programs for implementing each of the steps of the flow charts disclosed herein. It is also to be understood that the foregoing detailed description has been given for clearness of understanding only and is intended to be exemplary of the invention while not limiting the invention to the exact embodiment shown. Obviously certain modifications, variations and improvements will occur to those skilled in the art upon reading the foregoing. It is, therefore, to be understood that all such modifications, variations and improvements have been deleted herein for the sake of conciseness and readability, but are properly within the scope and spirit of the following claims.

What is claimed and desired to be secured by Letters of patent is:

1. A gaming device comprising:

a playfield that includes a plurality of display positions, wherein each display position, is used to display a letter of an alphabet, wherein a letter may be combined with adjacent letters to form a word, wherein the display positions are configured into groups, and wherein at least one word is hidden in the playfield, means for continuously shifting the letters at display positions in a group relative to the letters at display positions in another group, wherein a letter at a display position is continuously shifted to an adjacent display position in a group, means for randomly stopping said shifting of letters, means for determining if a hidden word is uncovered when the shifting of letters is randomly stopped, and means for determining a payout amount associated with uncovered word.

2. A gaming device as recited in claim 1, wherein the device is implemented as a bonus game in a primary gaming machine.

3. A gaming device as recited in claim 2, further comprising means for activating the bonus game.

4. A gaming device as recited in claim 1 wherein said groups are configured as at least one of a plurality of rows and a plurality of columns, and wherein said means for shifting letters includes means for rotating at least one of the letters for an entire row and letters for an entire column.

5. A gaming device as recited in claim 4, wherein the orientation of a hidden word is along at least one of a horizontal, a vertical, and a diagonal axis.

6. A gaming device as recited in claim 4, further comprising means for affording the player a plurality of opportunities to uncover hidden words.

7. A gaming device as recited in claim 1, wherein said means for randomly stopping the continuous shifting of letters employs a random number generator.

8. A gaming device comprising:

a playfield that includes a plurality of display positions, wherein each display position is used to display a letter of an alphabet, wherein a letter may be combined with adjacent letters to form a word, wherein the display positions are configured into groups, and wherein at least one word is hidden in the playfield, a microprocessor with a computer-readable medium encoded with a computer program to control the operation of the gaming device, a segment of the computer program to continuously shift the letters at display positions in a group relative to the letters at display positions in another group, wherein a letter at a display position is continuously shifted to an adjacent display position in a group, a segment of said computer program that randomly stops said shifting of letters, a segment of said computer program that determines if a hidden word is uncovered when the shifting of letters is randomly stopped, and a segment of said computer program that determines a payout amount associated with uncovered word.

9. A gaming device as recited in claim 8, wherein the device is implemented as a bonus game in a primary gaming machine that employs a plurality of rotating reels.

10. A gaming device as recited in claim 9 wherein the bonus game is activated upon the occurrence of a predetermined combination of indicia located on the rotating reels.

11. A gaming device as recited in claim 8 wherein the groups are arranged as an array of display positions, and wherein the shifting of letters includes the rotation of at least one the letters at an entire row and the letters at an entire column.

12. A gaming device as recited in claim 8, wherein said segment of the control program that randomly stops the continuous shifting of letters employs a random number generator.

13. A gaming device as recited in claim 11, wherein said segment of the computer program that randomly stops the shifting of letters employs a random number generator to stop the rotation of at least one of the letters at an entire row and the letters at an entire column at one of a plurality of stopping positions.

14. A gaming device comprising:

a playfield that is configured as an array of display positions, wherein each display position is used to display a letter of an alphabet, wherein a letter may be combined with adjacent letters to form a word, and wherein at least one word is hidden along a column, row, or a diagonal axis, a microprocessor with a computer-readable medium encoded with a computer program to control the operation of the gaming device, a program segment to continuously rotate at least one of the letters at an entire row and the letters at an entire column, wherein a letter at a display position is continuously shifted to an adjacent display position along a row or a column, a program segment that randomly stops said rotation, a program segment that determines if a hidden word is uncovered when the rotation is randomly stopped, and a program segment that determines a payout amount associated with uncovered word.

15. A gaming device as recited in claim 14, wherein the device is implemented as a bonus game in a primary gaming machine.

16. A gaming device as recited in claim 15, further comprising a program segment to afford the player a plurality of opportunities to uncover hidden words.

17. A gaming device as recited in claim 14, further comprising means for changing the time duration of said continued rotation.

18. A gaming device as recited in claim 14, wherein said program segment that randomly stops said continuous rotation generates a random number for each rotated row and column, and wherein a generated random number corresponds to one of a plurality of stopping positions.

19. A gaming device as recited in claim 14, wherein said program segment to rotate at least one of the letters at an entire row and the letters at an entire column is activated by an input control mechanism.

20. A method for a gaming device having a playfield that includes a plurality of display positions, wherein each display position is used to display a letter of an alphabet, wherein a letter may be combined with adjacent letters to form a word, wherein said display positions are configured into groups, and wherein at least one word is hidden in the playfield, comprising the steps of:

continuously shifting the letters at display positions in a group relative to the letters at display positions in another group, wherein a letter at a display position is continuously shifted to an adjacent display position in a group, randomly stopping the shifting of letters, determining, using a processor, if a hidden word is uncovered when said shifting is randomly stopped, and determining a payout amount associated with uncovered word.

* * * * *